US011754245B1

(12) United States Patent
Lee

(10) Patent No.: US 11,754,245 B1
(45) Date of Patent: Sep. 12, 2023

(54) LAMP MODULE FOR VEHICLE AND LAMP FOR VEHICLE INCLUDING THE SAME

(71) Applicant: HYUNDAI MOBIS CO., LTD., Seoul (KR)

(72) Inventor: Hyun Soo Lee, Yongin-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 18/063,517

(22) Filed: Dec. 8, 2022

(30) Foreign Application Priority Data

Jun. 13, 2022 (KR) ..... 10-2022-0071709

(51) Int. Cl.

| | |
|---|---|
| ***F21S 41/24*** | (2018.01) |
| ***F21S 41/25*** | (2018.01) |
| ***F21S 41/143*** | (2018.01) |
| ***F21S 41/32*** | (2018.01) |
| ***F21S 41/147*** | (2018.01) |
| *F21W 102/135* | (2018.01) |

(52) U.S. Cl.
CPC ..... *F21S 41/25* (2018.01); *F21S 41/143* (2018.01); *F21S 41/147* (2018.01); *F21S 41/24* (2018.01); *F21S 41/32* (2018.01); *F21W 2102/135* (2018.01)

(58) Field of Classification Search
None
See application file for complete search history.

(56) References Cited

U.S. PATENT DOCUMENTS

| | | | | |
|---|---|---|---|---|
| 2009/0027911 | A1* | 1/2009 | Misawa | F21V 7/0091 362/545 |
| 2015/0124472 | A1* | 5/2015 | Wintzer | F21S 41/24 362/522 |
| 2019/0017675 | A1* | 1/2019 | Suwa | F21S 41/24 |
| 2019/0203900 | A1* | 7/2019 | Nishimura | F21S 41/26 |

* cited by examiner

*Primary Examiner* — Elmito Breval
(74) *Attorney, Agent, or Firm* — DLA PIPER LLP (US)

(57) ABSTRACT

A lamp module for a vehicle includes a plurality of light sources that forms two kinds or more of light distribution patterns, a light guide provided in one side of the plurality of light sources, and in which a first recessed area having a shape recessed from a lower surface to an upper side is formed, and an optic part provided between some of the plurality of light sources and the light guide, and to which lights output from the some light sources are input, each of the plurality of light sources includes a first light source that faces a rear surface of the light guide on a rear side of the light guide, and a second light source that faces a lower surface of the light guide on a lower side of the light guide, and the optic part faces the second light source.

20 Claims, 5 Drawing Sheets

LAMP MODULE FOR VEHICLE AND LAMP FOR VEHICLE INCLUDING THE SAME

CROSS-REFERENCE TO RELATED APPLICATION

This application claims the benefit of priority to Korean Patent Application No. 10-2022-0071709, filed in the Korean Intellectual Property Office on Jun. 13, 2022, the entire contents of which are incorporated herein by reference.

TECHNICAL FIELD

The present disclosure relates to a lamp module for a vehicle and a lamp for a vehicle including the same, and more particularly, to a lamp module for a vehicle that has a structure with an improved optical efficiency, and a lamp for a vehicle including the same.

BACKGROUND

Various kinds of lamps for a vehicle are mounted on vehicles according to functions thereof. For example, a low beam lamp, a high beam lamp, a daytime running light (DRL) lamp, and the like are mounted on a front side of a vehicle.

According to a conventional technology, because various kinds of lamps are mounted on a vehicle together, light emitting surfaces formed by the lamps are different whereby requirements of consumers cannot be satisfied in an aspect of design of the vehicle when the lamps are switched on.

In addition, according to the conventional technology, because various kinds of lamps are mounted on the vehicle, spaces of the vehicle, which are occupied by the lamps, are excessively large.

SUMMARY

The present disclosure has been made to solve the above-mentioned problems occurring in the prior art while advantages achieved by the prior art are maintained intact.

An aspect of the present disclosure is to achieve differentiation in an aspect of design of a vehicle by allowing two or more functions to be performed in one lamp for a vehicle such that one light emitting surface is shared even when the lamps having different functions are switched on.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, a lamp module for a vehicle, includes a plurality of light sources that forms two kinds or more of light distribution patterns, a light guide provided in one side of the plurality of light sources, and in which a first recessed area having a shape recessed from a lower surface to an upper side is formed, and an optic part provided between some of the plurality of light sources and the light guide, and to which lights output from the some light sources are input, each of the plurality of light sources includes a first light source that faces a rear surface of the light guide on a rear side of the light guide, and a second light source that faces a lower surface of the light guide on a lower side of the light guide, and the optic part faces the second light source.

The light guide may include a first input surface formed on the rear surface of the light guide and to which at least a portion of the light output from the first light source is input, and a second input surface formed in the first recessed area of the light guide and to which at least a portion of the light output from the second light source and input to the optic part is input, and the second input surface may be located on a lower side of a function dividing surface that is an imaginary surface connecting an uppermost end of the rear surface of the light guide and a lower most end of a front surface of the light guide.

The optic part may include an optic input area formed in an area facing the second light source and to which at least a portion of the light output from the second light source is input, and an optic output area formed on an opposite side to a part of the optic part, in which the optic input area is formed, and from which at least a portion of the light input to the optic input area is output, the optic input area may condense the light output from the second light source to the optic input area, and the optic output area may diffuse the light condensed in the optic input area.

The optic input area may have a shape of a convex lens that protrudes toward the second light source, and the optic output area may have a shape of a concave lens that is recessed toward the second light source.

The first input surface may be formed in a curved shape that protrudes convexly toward the rear side of the light guide.

The first recessed area may include a first surface provided on a rear area of the first recessed area and inclined upwards as it goes to a front side, and a second surface provided on a front area of the first recessed area and inclined downwards as it goes to the front side, and the second light source may be provided in a forward/rearward width of the first surface.

The first recessed area may further include a third surface connecting an upper end of the first surface and an upper end of the second surface, and the third surface may include a forward extension section extending forwards from the first surface, and a downward extension section extending downwards from a front end of the forward extension section and connected to the second surface.

The first surface may have a linear shape when the first recessed area is cut in a horizontal direction.

A reflective layer may be formed on a surface of the first surface.

The third surface may further include a cutoff part formed in the forward extension section and having a stepped shape, of which heights of opposite side surfaces spaced apart from each other in a leftward/rightward direction are different.

The front surface of the light guide may include a first curved area having a curved shape protruding convexly toward the front side of the light guide, and a second curved area provided at an upper portion of the first curved area, and having a curved shape recessed concavely toward a rear side.

A radius of curvature of the second curved area may be smaller than a radius of curvature of the first curved area in a vicinity of an area, in which the first curved area and the second curved area contact each other.

At least a portion of the light output from the first light source may be output to an outside after passing through the rear surface of the light guide to form a first light distribution pattern, at least a portion of the light output from the second light source may be output to the outside after passing through the first recessed area of the light guide to form a second light distribution pattern, the first light distribution pattern may be formed by a portion of the light output from the first light source, which passes through the first curved area, and the second light distribution pattern may be formed by a portion of the light output from the second light source, which passes through the second curved area.

The optic part may be provided between the second light source and the second surface, and at least a portion of the light output from the second light source may reach the second curved area via the optic part and the second surface.

The lower surface of the light guide may include an inclined surface provided on a front side of the first recessed area, extending from a lower end of the first recessed area, and inclined upwards as it goes to the front side, and a reflective layer may be formed on a surface of the inclined surface.

The inclined surface may be located on a lower side of a function dividing surface that is an imaginary surface connecting an uppermost end of the rear surface of the light guide and a lower most end of the front surface of the light guide.

An angle formed by a direction facing an upper end of a lower end of the convex lens from the second light source and a direction that facing a middle area of the convex lens from the second light source may be 25 degrees to 35 degrees.

A lowermost end of the second curved area may be located on an imaginary surface connecting the second light source and an uppermost end of the inclined surface or may be located on a lower side of the imaginary surface.

The lamp module may further include a first board, to which the first light source is joined, a second board, to which the second light source is joined, and a heat sink attached to the first board and the second board.

An area of the heat sink, in which the first board is jointed, and an area of the heat sink, in which the second board is joined, may be integrally formed.

According to another aspect of the present disclosure, a lamp for a vehicle including a plurality of lamp modules, in which each of the plurality of lamp modules includes a plurality of light sources that forms two kinds or more of light distribution patterns, a light guide provided on one side of the plurality of light sources, and in which a first recessed area having a shape recessed from a lower surface to an upper side is formed, and an optic part provided between some of the plurality of light sources and the light guide, and to which lights output from some of the plurality of light sources are input, each of the plurality of light sources includes a first light source that faces a rear surface of the light guide on a rear side of the light guide, and a second light source that faces a lower surface of the light guide on a lower side of the light guide, and the optic part face the second light source.

The plurality of lamp modules may include a plurality of upper lamp modules provided on an upper side and arranged in a horizontal direction, and a plurality of lamp modules provided on a lower side of the upper lamp modules and arranged in the horizontal direction, and shapes of front surfaces of the light guides provided in the upper lamp modules and shapes of front surfaces of the light guides provided in the lower lamp modules are different.

Each of the front surfaces of the light guides may include a first curved area having a curved shape protruding convexly toward a front side of the light guide, and a second curved area provided at an upper portion of the first curved area and having a curved shape protruding convexly toward the front side, and a second recessed area provided on a lower side of the first curved area and having a shape recessed upwards, and the second recessed areas may be provided only in the plurality of lower lamp modules.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Hereinafter, a lamp module for a vehicle and lamp for a vehicle according to the present disclosure will be described with reference to the drawings.

Lamp Module for Vehicle

Figure 1:
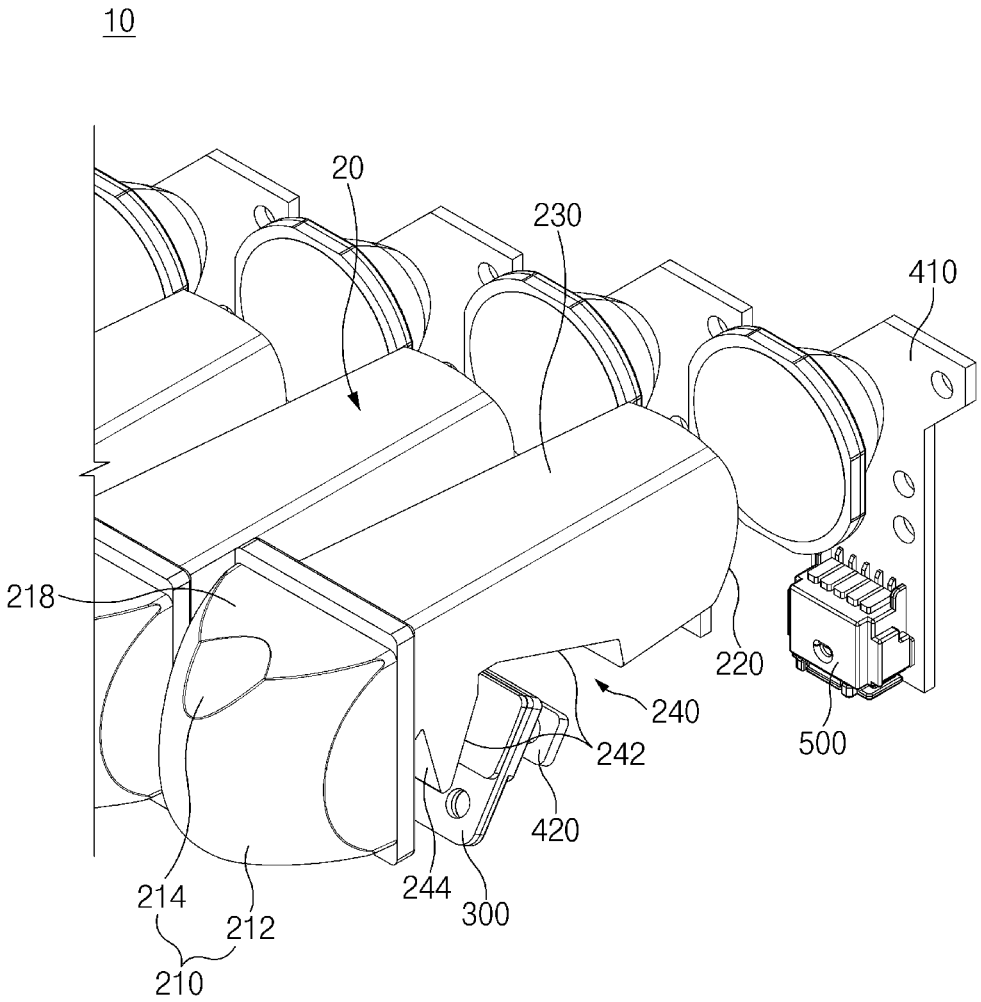
FIG. 1 is a perspective view illustrating a lamp module for a vehicle according to an example of the present disclosure.
Figure 2:
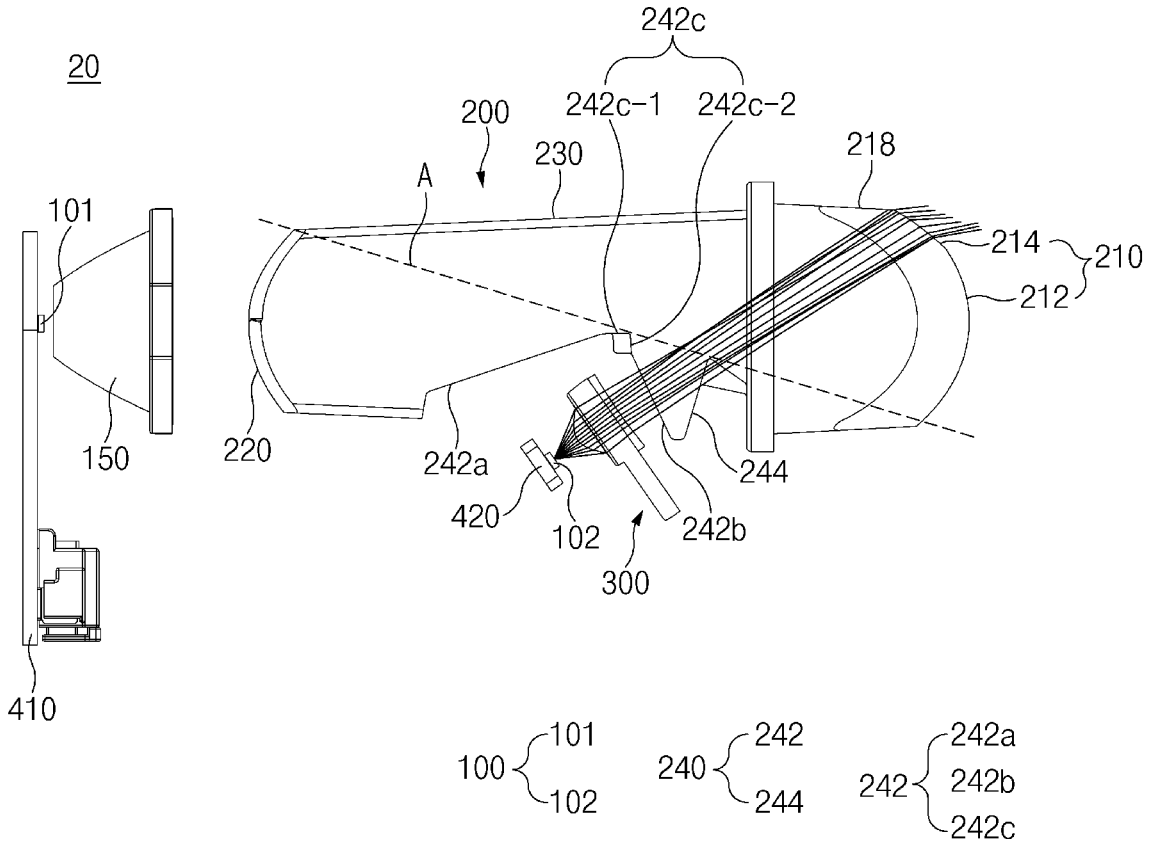
FIG. 2 is a side view illustrating a lamp module for a vehicle according to an example of the present disclosure.
Figure 3:
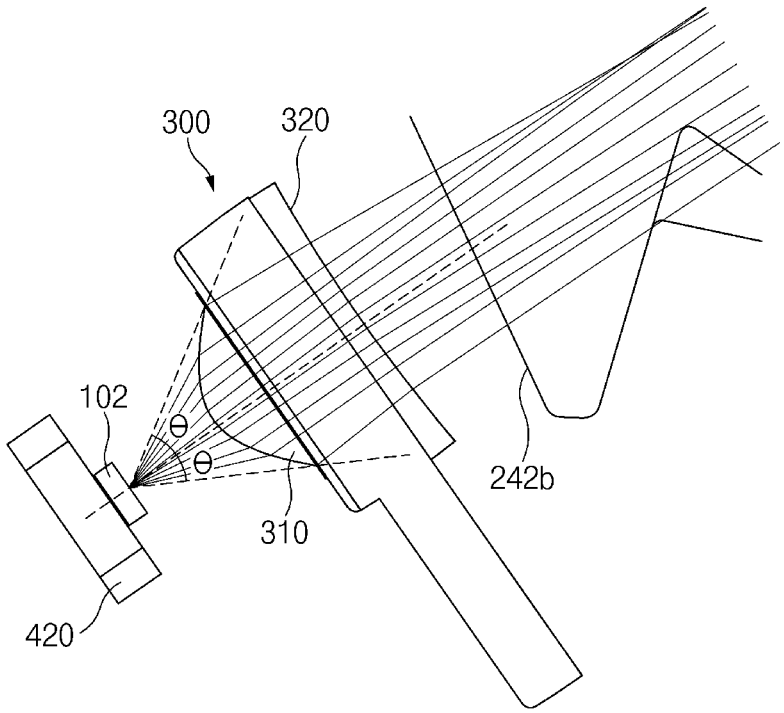
FIG. 3 is an enlarged side view illustrating a second light source and an optic part of a lamp module for a vehicle according to an example of the present disclosure.

FIG. 1 is a perspective view illustrating a lamp module for a vehicle according to an example of the present disclosure. FIG. 2 is a side view illustrating the lamp module for a vehicle according to the example of the present disclosure. FIG. 3 is an enlarged side view illustrating a second light source and an optic part of the lamp module for a vehicle according to the example of the present disclosure.

As illustrated in FIGS. 1 to 3, a lamp module 20 (hereinafter, referred to as a 'lamp module') for a vehicle according to the present disclosure may be a lamp module that may form two kinds or more of light distribution patterns. That is, the lamp module 20 according to the present disclosure may individually form a first light distribution pattern, and a second light distribution pattern that is different from the first light distribution pattern. As an example, the first light distribution pattern may be a low beam pattern, and the second light distribution pattern may be a DRL pattern. However, the kinds of the first light distribution pattern and the second light distribution pattern are not limited to the above-described ones, and may be applied to various kinds of beam patterns.

The lamp module 20 according to the present disclosure may include a plurality of light sources 100 that form two kinds or more of light distribution patterns, and a light guide 200 that are provided on one side of the plurality of light sources 100 and face the plurality of light sources 100. The light guide 200 may be a lens, in which configurations, which will be described below, are integrally formed. Accordingly, according to the present disclosure, because the first light distribution pattern and the second light distribution pattern may be formed through one integral lens, that is, the light guide 200, one light emitting surface may be shared through the one light guide and design aspects of the vehicle may be differentiated even when the light distribution pattern of different functions are formed.

A surface of the light guide 200 may be divided into a plurality of areas according to locations thereof. In more detail, the light guide 200 may include a front surface 210 that defines a front area of the light guide, a rear surface that defines a rear area of the light guide, an upper surface 230 that defines an upper area of the light guide, and a lower surface 240 that defines a lower area of the light guide. In particular, as illustrated in FIG. 2, a first recessed area 242 having an upwardly recessed shape may be formed on the lower surface 240 of the light guide 200.

Furthermore, the light source 100 may include a first light source 101 that faces the rear surface of the light guide 200 on a rear side of the light guide 200, and a second light source 102 that faces the lower surface 240 of the light guide 200 on a lower side of the light guide 200. As an example, the first light source 101 and the second light source 102 may be LEDs, but the kinds of the light sources are not limited to LEDs.

According to the present disclosure, at least a portion of the light output from the first light source 101 may be output to an outside after passing through the rear surface of the light guide 200 to form a first light distribution pattern, and at least a portion of the light output from the second light source 102 may be output to the outside after passing through the first recessed area 242 of the light guide 200 to form a second light distribution pattern. More preferably, the second light distribution pattern may be formed on an upper side of the first light distribution pattern.

Referring now to FIGS. 1 to 3, the lamp module 20 according to the present disclosure may further include an optic part 300 that is provided between some of the plurality of light sources 100 and the light guide 200 and to which the lights output from the some light sources are input. The optic part 300 is a configuration for transmitting light, and may be a configuration for using the lights output from the some light sources more efficiently by outputting the lights output from the some light sources after condensing them. In more detail, the optic part 300 may be configured to face the second light source 102. Accordingly, according to the present disclosure, because the light output from the second light source 102 may be output to the outside after being condensed in the optic part 300, the second light source 102 may be used more effectively, and light distributions formed by the second light distribution pattern also may be easily formed to satisfy rules.

Meanwhile, an area of the light guide 200, to which the first light source 101 is input, and an area of the light guide 200, to which the second light source 102 is input, may be spaced apart from each other. In more detail, referring to FIG. 2, the light guide 200 may include a first input surface 220, which is formed on the rear surface of the light guide 200 and to which at least a portion of the light output from the first light source 101 is input, and a second input surface 242*b*, which is formed in the first recessed area 242 of the light guide 200 and to which at least a portion of the light output from the second light source 102 and input to the optic part is input. As an example, the first input surface 220 may correspond to the entire rear surface of the light guide 200.

Furthermore, as illustrated in FIG. 2, according to the present disclosure, the second input surface 242*b* may be configured to be located on a lower side of a function dividing surface "A" that is an imaginary surface that connects an uppermost end of the rear surface of the light guide 200 and a lowermost end of the front surface 210 of the light guide 200. Then, the uppermost end of the rear surface of the light guide 200 may be understood as an area, in which it meets the upper surface 230 of the light guide 200 on the rear surface of the light guide 200, and the lowermost end of the front surface 210 of the light guide 200 may be understood as an area, in which it meets the lower surface 240 of the light guide 200 on the front surface 210 of the light guide 200.

The function dividing surface "A" may be a surface that imaginarily divide the light guide 200 into two areas by connecting the uppermost end of the rear surface and the lowermost end of the front surface 210 of the light guide 200, and may be a surface that is a reference for classifying an area, in which the above-described first light distribution pattern is formed, and an area, in which the second light distribution pattern is formed.

That is, according to the present disclosure, because the second input surface 242*b* is located on a lower side of the function dividing surface "A", the light output from the first light source 101 and input to the first input surface 220 and the light output from the second light source 102 and input to the second input surface 242*b* may be prevented from crossing each other or being interfered with each other, and thus, crossing and interferences of the different light distribution patterns may be prevented.

Meanwhile, the lamp module 20 according to the present disclosure may further include a collimator 150 provided between the first light source 101 and the light guide 200. The collimator 150 may be a configuration for converting the light output from the first light source 101 to parallel light and then supplying the parallel light to the light guide 200.

As described above, the optic part 300 may be a configuration for condensing the light output from the second light source 102 and then output the light. Then, the optic part 300 may include an optic input area 310 formed in an area that faces the second light source 102 and to which at least a portion of the light output from the second light source 102 is input, and an optic output area 320 formed on an opposite side to a portion of the optical part, in which the optic input area 310 is formed, and from which at least a portion of the light input to the optic input area 310 is output. In more detail, the optic output area 320, as illustrated in FIG. 2, may be configured to face the second input surface 242*b*. More preferably, most of the light output from the second light source 102 may be input to the optic input area 310.

Then, the optic input area 310 may be formed to condense the light output by the second light source 102 and input to the optic input area 310, and the optic output area 320 may be formed to diffuse the light condensed in the optic input area 310. To achieve the above-described object, the optic input area 310 may include a shape of a convex lens that protrudes toward the second light source 102, and the optic output area 320 may include a shape of a concave lens that is recessed toward the second light source 102. That is, according to the present disclosure, the light output from the second light source 102 may be condensed in an area of the optic input area 310, which has the shape of the convex lens, and then may be diffused in an area having the shape of the concave lens when being output from the optic output area 320.

Meanwhile, the convex lens formed in the optic input area 310 may have a size in a specific range. For example, referring to FIG. 3, an angle θ defined by a direction that faces an upper end or a lower end of the convex lens of the optic input area 310 from the second light source 102 and a direction that faces a middle area of the convex lens from the second light source 102 may be 25 to 35 degrees. This is for satisfying rule items required for a DRL pattern when the second light distribution pattern formed by the light output from the second light source 102 is the DRL pattern. More preferably, as illustrated in FIG. 3, i) an angle defined by a direction that faces the upper end of the convex lens of the optic input area 310 from the second light source 102 and a direction that faces the middle area of the convex lens from the second light source 102, and ii) an angle defined by a direction that faces the lower end of the convex lens of the optic input area 310 from the second light source 102 and a direction that faces the middle area of the convex lens from the second light source 102 may be the same Furthermore, the first input surface 220 of the light guide 200 may be formed in a curved shape that protrudes convexly toward the rear side of the light guide 200, that is, toward the first light source 101. Accordingly, the light output from the first light source 101 and converted to the parallel light by the collimator 150 may be condensed while passing through the first input surface 220.

Meanwhile, the first recessed area 242 of the above-described light guide 200 may be divided into a plurality of areas. In more detail, referring to FIGS. 1 and 2, the first recessed area 242 may include a first surface 242*a* provided in a rear area of the first recessed area 242 and inclined upwards as it goes to a front side, and a second surface 242*b* provided in a front area of the first recessed area 242 and inclined downwards as it goes to the front side. In particular, the second surface 242*b* may be the above-described second input surface. As an example, as illustrated in FIG. 2, the second light source 102 may be provided in a forward/rearward width of the first surface 242*a*.

Referring now to FIGS. 1 and 2, the first recessed area 242 may further include a third surface 242*c* that connects an upper end of the first surface 242*a* and an upper end of the second surface 242*b*. Then, the third surface 242*c* may include a forward extension section 242*c*-1 that extends forwards from the first surface 242*a*, and a downward extension section 242*c*-2 that extends downwards from a front end of the forward extension section 242*c*-1 and is connected to an upper end of the second surface 242*b*. That is, it may be understood that the third surface 242*c* has a substantially L-shape when the light guide 200 is viewed from a side.

Meanwhile, the first surface 242*a* may have a linear shape when the first recessed area 242 provided in the lamp module 20 according to the present disclosure is cut in a horizontal direction. This may be understood that the first surface 242*a* has a flat surface shape. However, unlike this, the first surface 242*a* may have a parabolic shape when the first recessed area 242 is cut in the horizontal direction.

Furthermore, according to the present disclosure, a reflective layer may be formed on a surface of the first surface 242*a*. Accordingly, according to the present disclosure, the light output from the first light source 101, which reaches the first surface 242*a*, may be reflected while not passing through the first surface 242*a*. As described above, the first light distribution pattern formed by the light output from the first light source 101 may be a low beam pattern, and the above-described reflective layer may contribute to satisfying the rule items required for the low beam pattern by preventing the light that is output from the first light source 101 and reaches the first surface 242*a* from being output to the front side.

In addition, to satisfy the rule items required for the low beam pattern, a cutoff part having a stepped shape may be further formed in the first recessed area. In more detail, the third surface 242*c* may further include the cutoff part that is formed in the forward extension section 242*c*-1 and has the stepped shape, in which heights of opposite side surfaces spaced apart from each other in a leftward/rightward direction (a direction that enters or exits from the paper with reference to FIG. 2). As described above, the first light distribution pattern formed by the first light source 101 may be a low beam pattern, and the cutoff part may be a configuration for forming a cutoff line that is required to be formed in an upper border area of the low beam pattern on the rules. That is, according to the present disclosure, the low beam pattern having the cutoff line may be formed as a portion of the light output from the first light source 101 is cut off by the cutoff part.

Meanwhile, according to the present disclosure, unlike the rear surface of the light guide 200 having a single curved shape, that is, the first input surface 220, the front surface 210 of the light guide 200 may have a plurality of curved areas. In more detail, referring to FIG. 1, the front surface 210 of the light guide 200 may include a first curved area 212 having a curved shape that protrudes convexly toward a front side of the light guide 200, and a second curved area 214 provided on an upper side of the first curved area 212 and having a curved shape that is recessed concavely toward a rear side.

The first curved area 212 may be an area, which the light output from the first light source 101 and input to the first input surface 220 reaches, and the second curved area 214 may be an area, which the light output from the second light source 102 and input to the second input surface 242*b* reaches. That is, the above-described first light distribution pattern may be formed by the light output from the first light source 101, which passes through the first curved area 212, and the above-described second light distribution pattern may be formed by the light output from the second light source 102, which passes through the second curved area 214. However, the light output from the first light source 101 does not reach the second curved area 214, and the light output from the second light source 102 may not reach the first curved area 212. Furthermore, the optic part 300 may be provided between the second light source 102 and the second input surface 242*b*, and at least a portion (more preferably, most of the light output from the second light source) of the light output from the second light source 102 may reach the second curved area 214 via the optic part 300 and the second input surface 242*b*.

As an example, as illustrated in FIG. 1, a portion of the second curved area 214 may be located on a lower side of an upper border of the first curved area 212, and another portion of the second curved area 214 may be located on an upper side of the upper border of the first curved area 212. This may be understood that a partial area of the upper border of the first curved area 212 has a downwardly recessed shape, and the second curved area 214 contacts the first curved area 212 in a downwardly recessed area of the upper border of the first curved area 212. However, when viewed as a whole, the second curved area 214 may be located on an upper side of the first curved area 212. Meanwhile, a size of the convex lens area of the optic input area 310 may correspond to a size of the second curved area 214 such that the light output from the second light source 102 and input to the convex lens area of the optic input area 310 reaches the second curved area 214.

Furthermore, according to the present disclosure, the first curved area 212 and the second curved area 214 may have different radii of curvature.

In more detail, as illustrated in FIG. 1, an average radius of curvature of the second curved area 214 may be smaller than an average radius of curvature of the first curved area 212, and a size of the second curved area 214 may be smaller than a size of the first curved area 212. More preferably, a radius of curvature of the second curved area 214 may be smaller than a radius of curvature of the first curved area 212 around an area, in which the first curved area 212 and the second curved area 214 contact each other.

Meanwhile, referring to FIG. 1, the front surface 210 of the light guide 200 may further include an additional area 218 that is formed on an upper side of the first curved area 212 and is configured to surround the second curved area 214. The additional area 218 may have a radius of curvature that is different from those of the first curved area 212 and the second curved area 214, and thus may be distinguished from the first curved area 212 and the second curved area 214. As illustrated in FIG. 1, a partial area of a lower border of the additional area 218 may have an upwardly recessed shape, and the second curved area 214 may contact the additional area 218 in an upwardly recessed area of the lower border of the additional area 218. That is, an entire circumference of the second curved area 214 may be surrounded by the first curved area 212 and the additional area 218. The additional area 218 may have a curved shape but may have a flat surface shape. A radius of curvature of the additional area 218 may be larger than those of the first curved area 212 and the second curved area 214 when the additional area 218 has a curved shape.

Unlike the first curved area 212 and the second curved area 214, the additional area 218 may be a configuration that substantially does not contribute formation of the first light distribution pattern and the second light distribution pattern. That is, according to the present disclosure, the lights output from the first light source 101 and the second light source 102 may not reach the additional area 218, or an amount of the lights, which substantially does not contribute to formation of the light distribution pattern, may reach the additional area 218. However, the additional area 218 may contribute to securing an aesthetic aspect of the lamp module 20 when the lamp module 20 is switched off, by preventing configurations, such as the first light source 101, the second light source 102, and the collimator 150, which are provided in the lamp module 20 according to the present disclosure, from being viewed from the outside.

Meanwhile, as illustrated in FIGS. 1 and 2, the lower surface 240 of the light guide 200 may further include an inclined surface 244 that extend from a lower end of the first recessed area 242 and is inclined upwards as it goes to the front side. In more detail, the inclined surface 244 may be located on a front side of the first recessed area 242, and may extend from a lower end of the second surface 242*b*.

Then, a reflective layer may be formed on a surface of the inclined surface 244. The reflective layer formed on a surface of the inclined surface 244 may prevent the light output from the second light source 102 from reaching the first curved area 212 by cutting off a portion of the light output from the second light source 102. Meanwhile, as illustrated in FIG. 2, the inclined surface 244 may be located on a lower side of the function dividing surface "A".

Meanwhile, referring to FIG. 2, a lower most end of the second curved area 214 may be located on or on a lower side of an imaginary surface that connects the second light source 102 and an uppermost end of the inclined surface 244. Then, the lowermost end of the second curved area 214 may mean a border, at which the second curved area 214 and the first curved area 212 meet each other. This may be for preventing the light output from the second light source 102 from reaching the first curved area 212.

Referring now to FIG. 1, the lamp module 20 according to an example of the present disclosure may include a first board 410, to which the first light source 101 is jointed, a second board 420, to which the second light source 102 is jointed, and a heat sink 500, to which the first board 410 is attached. The heat sink 500 may be a configuration for absorbing heat generated by the first light source 101 and discharging the heat to the outside. FIG. 1 illustrates a state, in which the second light source 102 and the second board 420 are spaced apart from the heat sink 500, as an example. This may be because the second light source 102 does not require heat dissipation by the heat sink as the heat generated by the second light source 102 is lower than that heat generated by the first light source 101 when the first light source 101 forms the low beam pattern and the second light source 102 forms the DRL pattern.

Figure 4:
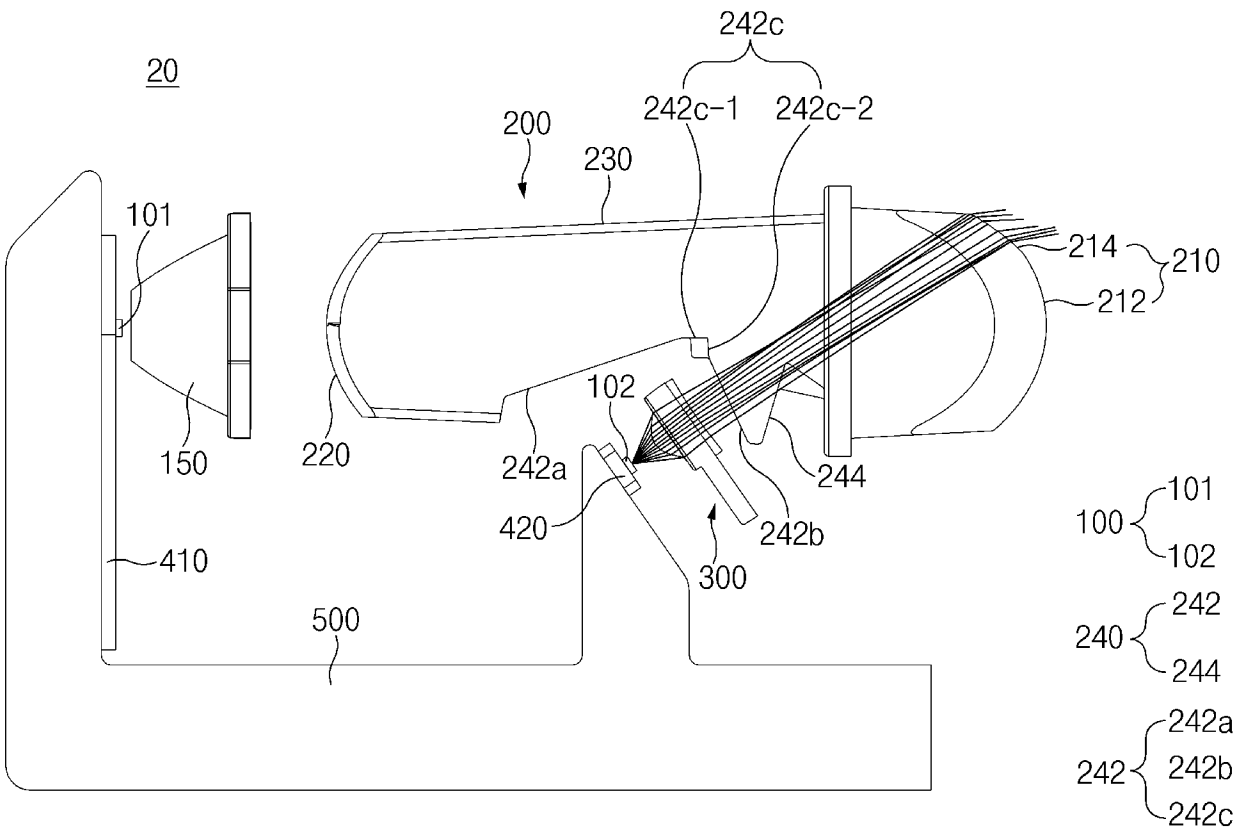
FIG. 4 is a side view illustrating a lamp module for a vehicle according to another example of the present disclosure.

FIG. 4 is a side view illustrating a lamp module for a vehicle according to another example of the present disclosure.

All the above-described contents on the lamp module 20 according to the present disclosure may be applied to the lamp module 20 according to the another example of the present disclosure in the same way. However, the another example of the present disclosure is different from the previous example of the present disclosure in that the heat sink 500 dissipates the heat generated by the second light source 102.

In more detail, according to the another example of the present disclosure, the lamp module 20 according to an example of the present disclosure may include the first board 410, to which the first light source 101 is jointed, the second board 420, to which the second light source 102 is jointed, and the heat sink 500 attached to the first board 410 and the second board 420.

Then, an area of the heat sink 500, to which the first board 410 is joined, and an area of the heat sink 500, to which the second board 420 is joined, may be integrally formed. Then, because the first light source 101 is configured to face the rear surface of the light guide 200 whereas the second light source 102 is configured to face the lower surface of the light guide 200, the heat sink 500 needs to have a shape that is bent in a substantially L shape as illustrated in FIG. 4 to absorb all the heat generated by the first light source 101 and the second light source 102.

Lamp for Vehicle

Figure 5:
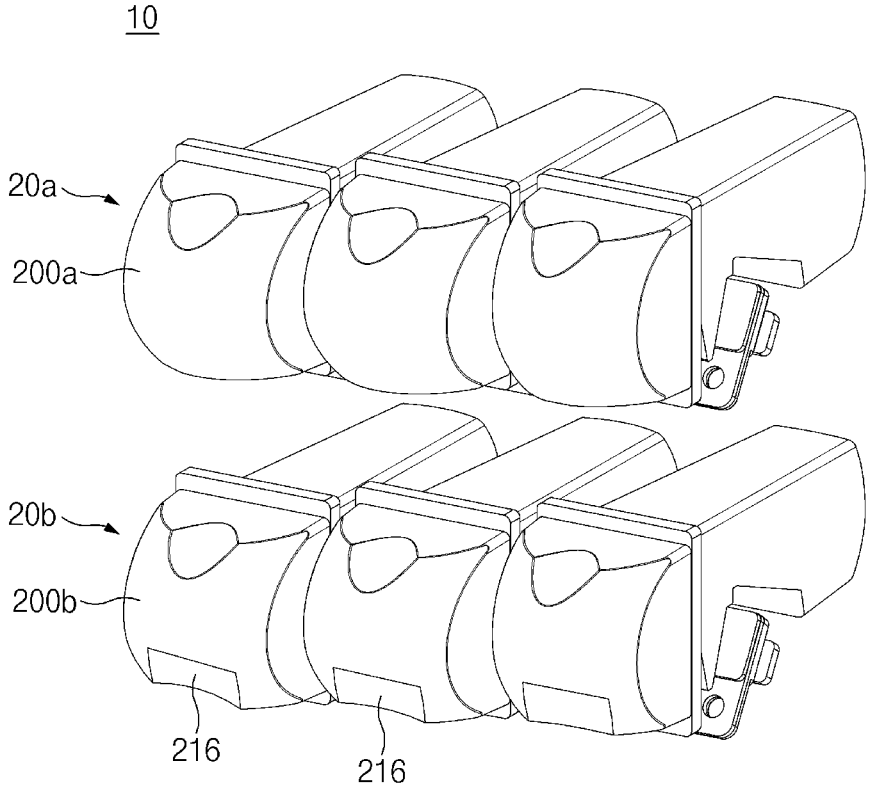
FIG. 5 is a perspective view illustrating a lamp for a vehicle, in which a plurality of lamp modules are provided, according to the present disclosure.

FIG. 5 is a perspective view illustrating a lamp for a vehicle, in which a plurality of lamp modules are provided, according to the present disclosure.

Referring to FIGS. 1 to 5, the lamp 10 (hereinafter, referred to as 'a lamp') for a vehicle according to the present disclosure may include a plurality of lamp modules 20.

Each of the plurality of lamp modules 20 may include the plurality of light sources 100 that form two kinds or more of light distribution patterns, the light guide 200 provided on one side of the plurality of light sources 100, and in which the first recessed area 242 having a shape recessed from a lower surface 240 to an upper side is formed, and the optic part 300 provided between some of the plurality of light sources 100 and the light guide 200, and to which lights output from some of the plurality of light sources are input.

The plurality of light sources 100 may include the first light source 101 that faces the rear surface of the light guide 200 on a rear side of the light guide 200, and the second light source 102 that faces the lower surface 240 of the light guide 200 on a lower side of the light guide 200. Then, the optic part 300 may be configured to face the second light source 102. As described above, the optic part 300 may be a configuration for condensing the light output from the second light source 102 more effectively. Meanwhile, the contents on the lamp module 20 provided in the lamp 10 according to the present disclosure will be replaced by the contents described above with reference to FIGS. 1 to 4.

Referring to FIG. 5, the plurality of lamp modules may include a plurality of upper lamp modules 20*a* provided on an upper side and arranged in a horizontal direction, and a plurality of lower lamp modules 20*b* provided on a lower side of the upper lamp modules 20*a* and arranged in the horizontal direction. Description of the upper lamp modules 20*a* and the lower lamp modules 20*b* will be replaced by the contents described with reference to FIGS. 1 to 4 in relation to the lamp module according to the present disclosure.

However, according to the present disclosure, a shape of the front surface of an upper light guide 200*a* provided in the upper lamp module 20*a* and a shape of the front surface of a lower light guide 200*b* provided in the lower lamp module 20*b* may be different. Hereinafter, the shapes of the light guides 200 provided in the upper lamp module 20*a* and the lower lamp module 20*b* will be described.

Referring to FIGS. 1, 2, and 5, the front surface of the lower light guide 200*b* may further include a second recessed area 216 having provided on a lower side of the first curved area 212 and having an upwardly recessed shape in addition to the first curved area 212 and the second curved area 214, which have been described above. However, the above-described second recessed area may not be provided on the front surface of the upper light guide 200*a*. That is, in the lamp 10 according to the present disclosure, the second recessed area 216 may be provided only in the plurality of lower lamp module 20*b*.

According to the present disclosure, differentiation in an aspect of design of a vehicle may be achieved by allowing two or more functions to be performed in one lamp for a vehicle such that one light emitting surface is shared even when the lamps having different functions are switched on.

Although it is apparent that the present disclosure has been described with reference to the limited embodiments and the drawings, the present disclosure is not limited thereto, and the present disclosure may be variously carried out by an ordinary person in the art within the technical spirit of the present disclosure and the equivalent ranges of the claims.

What is claimed is:

1. A lamp module for a vehicle, said lamp module comprising:

a plurality of light sources configured to form two or more kinds of light distribution patterns;

a light guide provided at one side of the plurality of light sources, and in which a first recessed area having a shape recessed from a lower surface to an upper side is formed; and an optic part provided between some of the plurality of light sources and the light guide, and to which light output from the some of the plurality of light sources is input, wherein each of the plurality of light sources includes:

a first light source configured to face a rear surface of the light guide on a rear side of the light guide; and a second light source configured to face a lower surface of the light guide on a lower side of the light guide, and the optic part is configured to face the second light source.

2. The lamp module of claim 1, wherein the light guide includes:

a first input surface formed on the rear surface of the light guide and to which at least a portion of the light output from the first light source is input; and a second input surface formed in the first recessed area of the light guide and to which at least a portion of the light output from the second light source and input by the optic part is input, wherein the second input surface is located on a lower side of a function dividing surface that is an imaginary surface connecting an uppermost end of the rear surface of the light guide and a lowermost end of a front surface of the light guide.

3. The lamp module of claim 1, wherein the optic part includes:

an optic input area formed in an area facing the second light source and to which at least a portion of the light output from the second light source is input; and an optic output area formed on an opposite side to a part of the optic part, in which the optic input area is formed, and from which at least a portion of the light input to the optic input area is output, wherein the optic input area is configured to condense the light output from the second light source to the optic input area, and the optic output area is configured to diffuse the light condensed in the optic input area.

4. The lamp module of claim 3, wherein the optic input area has a shape of a convex lens that protrudes toward the second light source, and the optic output area has a shape of a concave lens that is recessed toward the second light source.

5. The lamp module of claim 4, wherein an angle formed by a direction facing an upper end or a lower end of the convex lens from the second light source and a direction that facing a middle area of the convex lens from the second light source is about 25 degrees to 35 degrees.

6. The lamp module of claim 1, wherein a first input surface is formed in a curved shape that protrudes convexly toward the rear side of the light guide.

7. The lamp module of claim 1, wherein the first recessed area includes:

a first surface provided on a rear area of the first recessed area and inclined upwards toward a front side; and a second surface provided on a front area of the first recessed area and inclined downwards toward the front side, wherein the second light source is provided in a forward/rearward width of the first surface.

8. The lamp module of claim 7, wherein the first recessed area further includes:

a third surface connecting an upper end of the first surface and an upper end of the second surface, wherein the third surface includes:

a forward extension section extending forwards from the first surface; and a downward extension section extending downwards from a front end of the forward extension section and connected to the second surface.

9. The lamp module of claim 8, wherein the third surface further includes:

a cutoff part formed in the forward extension section and having a stepped shape, of which heights of opposite side surfaces spaced apart from each other in a leftward/rightward direction are different.

10. The lamp module of claim 7, wherein the first surface has a linear shape in a horizontal direction.

11. The lamp module of claim 7, wherein a reflective layer is formed on a surface of the first surface.

12. The lamp module of claim 7, wherein a front surface of the light guide includes:

a first curved area having a curved shape protruding convexly toward the front side of the light guide; and a second curved area provided at an upper portion of the first curved area and having a curved shape recessed concavely toward a rear side.

13. The lamp module of claim 12, wherein a radius of curvature of the second curved area is smaller than a radius of curvature of the first curved area in an area in which the first curved area and the second curved area contact each other.

14. The lamp module of claim 12, wherein:

at least a portion of the light output from the first light source is output to an outside after passing through the rear surface of the light guide to form a first light distribution pattern, at least a portion of the light output from the second light source is output to the outside after passing through the first recessed area of the light guide to form a second light distribution pattern, the first light distribution pattern is formed by a portion of the light output from the first light source, which passes through the first curved area, and the second light distribution pattern is formed by a portion of the light output from the second light source, which passes through the second curved area.

15. The lamp module of claim 12, wherein the optic part is provided between the second light source and the second surface, and at least a portion of the light output from the second light source reaches the second curved area via the optic part and the second surface.

16. The lamp module of claim 12, wherein the lower surface of the light guide includes:

an inclined surface provided on a front side of the first recessed area, extending from a lower end of the first recessed area, and inclined upwards as it goes to the front side, wherein a reflective layer is formed on a surface of the inclined surface.

17. The lamp module of claim 16, wherein the inclined surface is located on a lower side of a function dividing surface that is an imaginary surface connecting an uppermost end of the rear surface of the light guide and a lower most end of the front surface of the light guide.

18. The lamp module of claim 16, wherein a lowermost end of the second curved area is located on an imaginary surface connecting the second light source and an uppermost end of the inclined surface or is located on a lower side of the imaginary surface.

19. A lamp for a vehicle including a plurality of lamp modules, wherein each of the plurality of lamp modules includes:

a plurality of light sources configured to form two or more kinds of light distribution patterns;

a light guide provided at one side of the plurality of light sources, and in which a first recessed area having a shape recessed from a lower surface to an upper side is formed; and an optic part provided between some of the plurality of light sources and the light guide, and to which light output from some of the plurality of light sources are input, wherein each of the plurality of light sources includes:

a first light source configured to face a rear surface of the light guide on a rear side of the light guide; and a second light source configured to face a lower surface of the light guide on a lower side of the light guide, wherein the optic part is configured to face the second light source.

20. The lamp of claim 19, wherein the plurality of lamp modules include:

a plurality of upper lamp modules provided on an upper side and arranged in a horizontal direction; and a plurality of lamp modules provided on a lower side of the upper lamp modules and arranged in the horizontal direction, wherein shapes of front surfaces of the light guides provided in the upper lamp modules and shapes of front surfaces of the light guides provided in the lower lamp modules are different, and each of the front surfaces of the light guides includes:

a first curved area having a curved shape protruding convexly toward a front side of the light guide;

a second curved area provided at an upper portion of the first curved area and having a curved shape protruding convexly toward the front side; and a second recessed area provided on a lower side of the first curved area and having a shape recessed upwards, and wherein the second recessed areas are provided only in the plurality of lower lamp modules.

* * * * *